US008653975B2

(12) United States Patent
Deavours

(10) Patent No.: US 8,653,975 B2
(45) Date of Patent: Feb. 18, 2014

(54) RADIO-FREQUENCY IDENTIFICATION DEVICE WITH FOAM SUBSTRATE

(75) Inventor: Daniel D. Deavours, Lawrence, KS (US)

(73) Assignee: The University of Kansas, Lawrence, KS (US)

( * ) Notice: Subject to any disclaimer, the term of this patent is extended or adjusted under 35 U.S.C. 154(b) by 912 days.

(21) Appl. No.: 12/327,686

(22) Filed: Dec. 3, 2008

(65) Prior Publication Data

US 2010/0134292 A1 Jun. 3, 2010

(51) Int. Cl.
*G08B 13/14* (2006.01)
*H01Q 9/16* (2006.01)

(52) U.S. Cl.
USPC ..... 340/572.7; 343/822

(58) Field of Classification Search
USPC ..... 340/10.1; 343/850
See application file for complete search history.

(56) References Cited

U.S. PATENT DOCUMENTS

| | | | | |
|---|---|---|---|---|
| 6,329,915 | B1 | 12/2001 | Brady | |
| 6,441,740 | B1 | 8/2002 | Brady | |
| 7,298,273 | B2 | 11/2007 | Baba | |
| 7,394,382 | B2 | 7/2008 | Nitzan | |
| 7,400,298 | B2 | 7/2008 | Fogg | |
| 7,443,347 | B2 | 10/2008 | Mei | |
| 2001/0054755 | A1 | 12/2001 | Kirkham | |
| 2002/0044100 | A1 * | 4/2002 | Jagielski et al. | 343/850 |
| 2006/0208900 | A1 | 9/2006 | Tavassoli | |
| 2006/0255945 | A1 | 11/2006 | Egbert | |
| 2006/0271328 | A1 | 11/2006 | Forster | |
| 2006/0284770 | A1 | 12/2006 | Jo | |
| 2007/0200711 | A1 | 8/2007 | Kai | |

OTHER PUBLICATIONS

International Search Report, PCT/US2008/085432, Mailing Date Feb. 3, 2009.*

D. M. Dobkins & S. Weigand, "Environmental effects on RFID Tag Antennas," in IEEE MTT-S International Microwave Symposium, Long Beach, CA, Jun. 2005, Enigmatics, Sunnyvale, CA, USA and WJ Communications, San Jose, CA USA.

J. D. Griffin, G. D. Durgin, A. Haldi, & B. Kippelen, "RF Tag Antenna Performance on Various Materials Using Radio Link Budgets," antennas and Wireless Propagation Letters, vol. 5, No. 1, Dec. 2006.

K. M. Ramakrishnan & D. D. Deavours, "Performance benchmarks for Passive UHF RFID Tags", in 13th GI/ITG Conference on Measurement, Modeling, and Evaluation of Computer Communication systems, Nuremberg, Germany, Mar. 2006; Information & Telecommunications Technology Center, Lawrence, KS.

(Continued)

*Primary Examiner* — Brian Zimmerman
*Assistant Examiner* — Cal Eustaquio
(74) *Attorney, Agent, or Firm* — Spencer Fane Britt & Browne LLP

(57) ABSTRACT

The present invention encompasses an antenna (12) for use with a radio-frequency identification transponder (10) that performs optimally in free space and near optimally when near a conductive surface. The radio-frequency identification transponder (10) broadly comprises an antenna (12); an integrated circuit (14); a matching circuit (16) interposed between the antenna (12) and integrated circuit (14); and a substrate (18). The antenna (12) is designed with a length so the antenna (12) as a microstrip resonates at a starting frequency and a matching circuit is constructed. The antenna (12) is placed near a conductive surface and the length of the antenna is adjusted until the antenna reactance is approximately the opposite of the integrated circuit reactance.

20 Claims, 4 Drawing Sheets

(56) References Cited

OTHER PUBLICATIONS

S.R. Aroor & D. D. Deavours, "Evaluation of the State of Passive UHF RFID: An Experimental Approach," IEEE Systems Journal, vol. 1, No. 2, 2007.
M. Hirvonen, P. Pursula, K. Jaakkola, & K. L. Laukkanen, "Planar Inverted-F Antenna for Radio Frequency Identification," Electronics Letters, vol. 40, No. 14, Jul. 2004.
L. Ukkonen, L. Sydanheimo, Markku Kivikoski, "A Novel Tag Design Using Inverted-F Antenna for Radio Frequency Identification of Metallic Objects," in 2004 IEEE/Sarnoff Symposium on Advances in Wired & Wireless Communications, 2004, Tampere University of Technology, Institute of Electronics, Rauma Research Unit, Rauma, Finland.
H. Kwon & B. Lee, "Compact slotted Planar Inverted-F- RFID Tag Mountable on Metallic Objects," Electronic Letters, vol. 41, No. 24, Nov. 2005.
H. W. Son, G. Y. Choi, & C. S. Pyo, "Design of Wideband RFID Tag Antenna for Metallic Surfaces," Electronics Letters, vol. 42, No. 5, Mar. 2006.
J.C.-E. Sten, A. Hujanen, & P.K. Koivisto, "Quality Factor of an Electrically Small Antenna Radiating Close to a Conducting Plane," IEEE Transactions on Antennas & Propagation, vol. 49, No. 5,, May 2001.
G. Marrocco, "The Art of UHF RFID Antenna Design: Impedance-Matching & Size-Reduction Techniques," IEEE Antennas and Propagation Magazine, vol. 50, No. 1. Feb. 2008.
M. Eunni, M. Sivakumar, & D. D. Deavours, "A Novel Planar Microstrip Antenna Design for UHF RFID," Journal of Systemics, Cybernetics and Informatics, vol. 5. No. 1. Jan. 2007.
P.R. Nikitin, K.V.S. Rao, S.F. Lam, V. Pillai, R. Martinez, & H. Heinrich, "Power Reflection Coefficient Analysis for Complex Impedances in RFID Tag Design," IEEE Transactions on Microwave Theory and Technique, vol. 53, No. 9. Sep. 2005.
P.V. Nikitin & K.V.S. Rao, "Reply to 'Comments on "Antenna design for UHF RFID Tags: A Review and Practical Application'"," IEEE Transactions on Antennas and Propagation, vol. 54, No. 6. Jun. 2006.
S. Uda, Yagi-Uda Antenna. Tohoku University: Research Institute of Electrical Communication, 1954, pp. 119-142.

* cited by examiner

30

RADIO-FREQUENCY IDENTIFICATION DEVICE WITH FOAM SUBSTRATE

FIELD OF THE INVENTION

The present invention relates to the field of antennas and wireless communication. In particular, the invention pertains to the fields of passive ultra high frequency (UHF) radio frequency identification devices (RFID), to passive UHF RFID transponders, to passive UHF RFID transponder antenna design, and, more specifically, to passive UHF RFID transponder antennas that work optimally in free space and near optimally when placed near a conductive surface.

BACKGROUND OF THE INVENTION

A UHF RFID transponder, sometimes called a "tag," generally comprises an antenna, a matching circuit, an integrated circuit (IC), and a substrate. The antenna may be constructed from etched, vapor-deposited, chemically deposited, or electro-deposited copper or aluminum, or from conductive silver inks. The matching circuit may be integrated into the antenna design. The IC is electrically connected to the antenna, such as by a direct electrical connection or a capacitive connection. The substrate may be a PET polyester or paper. The transponder may be provided with a pressure-sensitive adhesive or the transponder may be integrated into a printable or printed label to facilitate application of the transponder to an object.

Transponder performance is degraded when the transponder is placed near metal, e.g., applied to a metal object. A spacer, which may be made of foam, may be interposed between the transponder and the conductive surface. The resulting separation mitigates the problem but does not eliminate it. Thus, the transponder continues to suffer from significant degradation in performance. In some instances, the transponder operates at approximately 1-3% efficiency.

SUMMARY OF THE INVENTION

The present invention overcomes the above-identified and other problems and disadvantages by providing a transponder that performs optimally or near-optimally (as defined below) in free space or near a conductive surface.

Generally, the transponder consists of an antenna, an integrated circuit, a matching circuit interposed between the antenna and the integrated circuit, and a substrate underlying the antenna, integrated circuit, and matching circuit.

In one embodiment, the substrate comprises a foam. In one embodiment, the foam is at least approximately one-eighth inch thick. In another embodiment, the substrate comprises an elastomer.

In one embodiment, the maximum transfer efficiency of the antenna is at least 95% when the transponder is operating in free space and at least 5% when the transponder is placed near a conductive surface. In another embodiment, the maximum transfer efficiency of the antenna is at least 95% when the transponder is operating in free space and at least 10% when the transponder is placed near a conductive surface. In yet another embodiment, the maximum transfer efficiency of the antenna is at least 95% when the transponder is operating in free space and at least 25% when the transponder is placed near a conductive surface. In another embodiment, the maximum transfer efficiency of the antenna is at least 95% when the transponder is operating in free space and at least 80% when the transponder is placed near a conductive surface In one embodiment, a method for making an antenna comprises the steps of: determining acceptance criteria based on the directivity, efficiency, and power transfer efficiency; using numerical simulation to estimate performance of an antenna in free space; evaluating antennas for acceptable results in free space based on acceptance criteria; simulating antennas identified in the previous step; selecting antennas achieving acceptable results near a conductive surface based on the acceptance criteria; and if no antennas achieve acceptable results near a conductive surface based on the acceptance criteria, relaxing one of the variables of the acceptance criteria and repeating all previous steps until an acceptable antenna is found.

In one embodiment, a system for identification comprising an RFID transponder includes: an antenna; an integrated circuit; and wherein the impedance of the antenna is substantially similar to the conjugate impedance of the integrated circuit when the transponder is in free space or placed near a conductive surface. In one embodiment, the system is used for tracking shipments. In another embodiment, the system is used in a distribution center or a retail operation.

In one embodiment, the antenna is operable to present an impedance substantially similar to the conjugate impedance of the integrated circuit when the RFID transponder is operating in free space or when placed near a conductive surface. In another embodiment, the antenna is operable to present an impedance within approximately 50% of the conjugate impedance of the integrated circuit when the RFID transponder is operating in free space or when placed near a conductive surface. In another embodiment, the antenna is operable to present an impedance within approximately 25% of the conjugate impedance of the integrated circuit when the RFID transponder is operating in free space or when placed near a conductive surface. In yet another embodiment, the antenna is operable to present an impedance within approximately 10% of the conjugate impedance of the integrated circuit when the RFID transponder is operating in free space or when placed near a conductive surface.

In one embodiment, the read range is at least approximately 20 feet when the transponder is placed near a conductive surface, and the read range is at least approximately 20 feet when the transponder is in free space.

In one embodiment, the method for making an antenna comprises the steps of: designing an antenna with a length so the antenna as a microstrip resonates at approximately 960 MHz; constructing a matching circuit so the antenna operates efficiently in free space; placing the antenna near a conductive surface and observing impedance; if the reactance is too small (less than the opposite of the integrated circuit reactance) at 915 MHz, adjusting the length of the antenna until the desired reactance is observed; modifying the matching circuit to provide an optimal impedance in free space; placing the antenna near a conductive surface and observing the reactance; adjusting the length of the antenna to achieve the desired reactance as a microstrip; and repeating the above steps until the desired free-space performance and the desired reactance as a microstrip is achieved.

These and other novel features of the present invention are described in more detail in the section titled DETAILED DESCRIPTION, below.

BRIEF DESCRIPTION OF THE DRAWING FIGURES

The present invention is described herein with reference to the following drawing figures, with greater emphasis being placed on clarity rather than scale:

DETAILED DESCRIPTION OF THE INVENTION

With reference to the drawings figures, an RFID transponder is herein described, shown, and otherwise disclosed in accordance with various embodiments, including a preferred embodiment, of the present invention.

Figure 1:
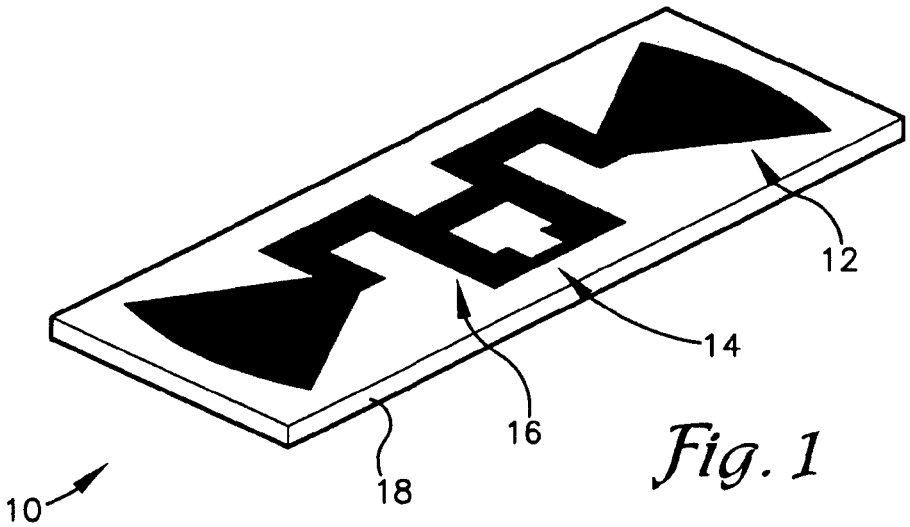
FIG. 1 is an isometric view of an embodiment of the RFID transponder of the present invention.

Referring to FIG. 1, the RFID transponder 10 broadly comprises an antenna 12; an IC 14; a matching circuit 16 interposed between the antenna 12 and IC 14; and a substrate 18. The transponder 10 provides optimal performance in free space and near-optimal performance near a conductive surface.

As used herein, the term "optimal" and variations thereof generally mean a condition in which the antenna operates at a moderate level of efficiency, limited by such factors as the geometry, materials, and environment, and presents an impedance that is or is close to the complex conjugate of the IC's impedance. Thus, the read distance is not decreased significantly, and in some cases may be increased due to increased directivity.

In free space, the antenna 12 behaves as a dipole antenna, exhibits excellent efficiency, and achieves an optimal impedance match, so that the transponder performs optimally relative to the capability of the IC 14, i.e., within approximately 95% of the maximum achievable or desired antenna efficiency and power transfer efficiency. When placed near a conductive surface, the transponder's power transfer efficiency is at least approximately 5%. Transponders not utilizing this invention in a similar environment exhibit efficiencies of between approximately 1% and 3%.

Figure 2:
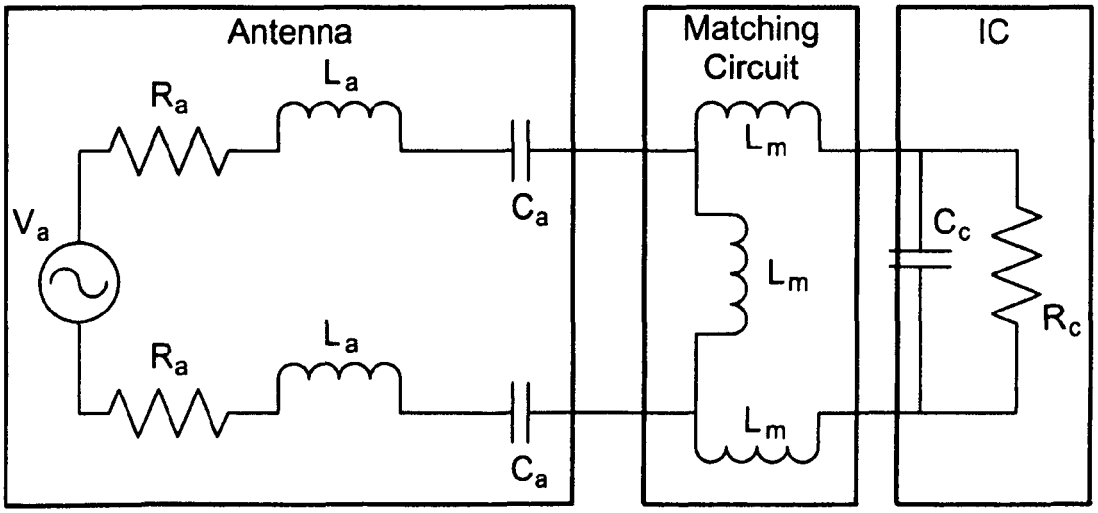
FIG. 2 is a circuit model of the RFID transponder behaving as if it had a dipole antenna.

A circuit model of the transponder 10 in which the antenna 12 is behaving as a dipole antenna is shown in FIG. 2. The traditional RLC (an electrical circuit consisting of a resistor (R), an inductor (L), and a capacitor (C)) series circuit model of a dipole antenna is divided into two for convenience. An even/odd mode analysis on the circuit shows that the circuit can be divided into two along a horizontal line of symmetry (cutting $L_s$ in half), thereby simplifying the analysis. Then, the matching circuit 16 becomes an L-shaped matching circuit using two inductors. The inductors are used to provide proper impedance matching from the antenna 12 to the IC 14 impedance.

Figure 3:
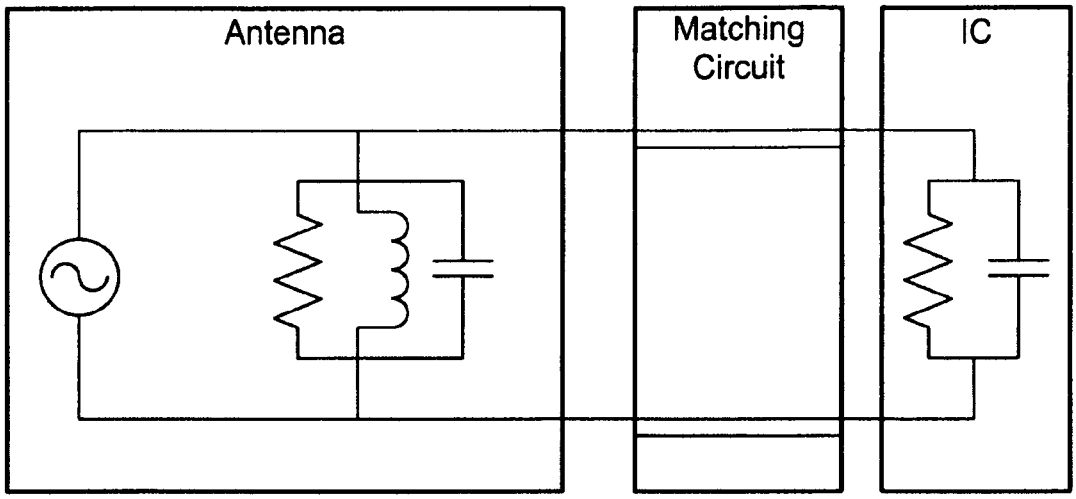
FIG. 3 is a circuit model of the RFID transponder behaving as if it had a microstrip antenna.

A circuit model of the transponder 10 in which the antenna 12 is behaving as a microstrip antenna is shown in FIG. 3. The transponder's impedance behavior is changed from one that resembles a series RLC circuit to one that more closely resembles a parallel RLC circuit. The matching circuit 16 changes from an L-shaped matching circuit using inductors to one using transmission lines.

The physical realizations of a dipole antenna of FIG. 2 and the balanced-feed microstrip antenna of FIG. 3 are identical, but the functional realizations of the physical designs are substantially different in different environments. The physical realization of the antenna 12 can be constructed such that the functional behavior of the antenna 12 in free space (modeled as a dipole antenna an L-shaped matching circuit using inductors) operates optimally and the functional behavior of the antenna 12 near a conductive surface (modeled as a microstrip antenna with balanced feeds and a matching circuit using transmission lines) can also behave optimally or near optimally. Finding an optimal antenna is an under-constrained problem, i.e., there is a large family of solutions to the problem, and, therefore, there is considerable freedom in choosing which solution to implement. The present invention is based, at least in part, on the realization that the family of optimal solutions for dipole antennas intersects or nearly intersects the family of optimal solutions for microstrip antennas.

With regard to the substrate 18, or backing, an approximately ⅛ inch foam substrate is able to operate at a substantial level of performance in both dipole and microstrip modes. Thicker foam substrates may be able to achieve very high levels of radiation efficiency and power transfer efficiency. Thinner foam substrates, e.g., 1/16 inch, may require greater compromises, especially with the reduction in antenna efficiency and bandwidth. Substrates other than foam, such as an elastomer, may require other compromises. Smaller form factors (length and width) will require different compromises.

Experimental testing of the transponder 10 shown in FIG. 1, show that in free-space the transponder 10 has a radiating efficiency of almost 100% and a power transfer efficiency of over 95%. When the transponder 10 is placed over a copper ground plane, the radiating efficiency is reduced substantially (for reasons that are outside the scope of the present invention), but the power transfer efficiency is still over 80%. It is contemplated that a transponder can be produced having a power transfer efficiency of over 90% both in free-space and near a conductive surface.

Experimental testing of the transponder 10 of FIG. 1, in which the substrate 18 is ⅛ inch HDPE foam, show that when placed near a conductive surface the transponder 10 has a simulated read distance of approximately 26 feet. A prior art transponder, model AL-9540, placed near a conductive surface and having the same foam spacer and using the same IC, had a read distance of approximately 3 feet. The two transponders behaved nearly identically in free space.

The power transfer efficiency of a transponder can be defined as follows:

$$\tau = \frac{4R_a R_c}{|Z_a + Z_c|^2}$$

Here, $Z_a$ and $Z_c$ are the antenna and IC impedances, $R_a$=Re($Z_a$) and $R_c$=Re($Z_c$). Optimal power transfer efficiency occurs when $Z_a$ and $Z_c$ are complex conjugates. As the IC impedance is fixed, the antenna impedance is adjusted, normally through a matching circuit, to be the complex conjugate of the IC impedance.

Assuming that a transponder is limited by the amount of power that gets to the IC, performance for a particular transponder can be estimated as $D\eta\tau\rho$, where D is the directivity of the transponder (formally, in polar coordinates, $D(\theta,\phi)$, where $\theta$ and $\phi$ are angles in the polar coordinate system), $\eta$ is the radiating efficiency, or the efficiency of the antenna, $\tau$ is the power transfer efficiency defined above, and $\rho$ is the polarization mismatch (typically 50% from circularly polarized reader antennas to linearly-polarized tag antennas). The directivity of the antenna is largely determined by the geometry of the antenna. D is not considered when defining optimality.

It is somewhat important to consider antenna efficiency in defining optimality. Normally, dipole antennas perform close to 100% efficiency, and over 95% efficiency is not uncommon. Microstrip antennas, especially compact and low-profile microstrip antennas, typically exhibit a significant reduction in efficiency. Sources of loss include dielectric loss, conductive loss, and surface wave loss (resulting from waves that get trapped in the substrate or are redirected due to the substrate-air boundary). For low dielectric foam substrates, surface wave losses are practically insignificant. Dielectric losses are primarily defined by the dielectric of the material of the substrate. HDPE foam typically results in a very low loss substrate because HDPE itself is a low-loss material, and HDPE foams are typically 90% or more air. However, cross linking agents used to make HDPE foam more flexible, adhesives and other materials may contribute significantly to the dielectric losses. Conductive losses are due to the finite conductivity of metals or inks used to construct the antenna. Frequently, conductive losses are the primary source of loss.

Conductive losses can be mitigated by several factors, including the material, e.g., copper versus aluminum or silver inks, used to construct the antenna; the width and meander of the antenna, which also affects antenna efficiency and radiating resistance; and the width of the transmission lines. For the present purpose, these factors are environmental factors to be considered and addressed during the engineering design process.

One antenna efficiency factor that is not considered an environmental factor is how closely the microstrip antenna operates to its resonant frequency. One way that the present invention achieves good power transfer efficiency in both the dipole mode and the microstrip mode is that, in the microstrip mode, it operates a small distance in frequency from its resonant frequency. For example, a prototype transponder was designed to perform optimally at approximately 915 MHz, but more generally over the range of 902 MHz to 928 MHz, but it has a resonant frequency of approximately 960 MHz. A small but detectable reduction, perhaps as much as 1 dB, in efficiency can result from operating below (or above) the resonant frequency. Thus, this is one factor that can be used to define optimality. For example, if the efficiency of an antenna is −5 dB at resonance at 960 MHz, but the antenna actually operates at −6 dB at 915 MHz, then the antenna efficiency is 1 dB below optimal.

Power transfer efficiency (discussed above) is another factor considered in defining optimality. Again, the reduction in power transfer efficiency from a desired efficiency value, which is not 100%, is considered a reduction in optimality. It is common practice to match the antenna to a slightly larger resistance and smaller reactance so as to make the transponder more robust against environmental factors, and thereby lose approximately 0.5 to 1 dB of power transfer efficiency. Also, any polarization losses are ignored in defining optimality. If an antenna resistance equal to the IC resistance cannot be achieved, or for bandwidth consideration, is not desired to be achieved, then optimal performance is achieved by modifying the antenna reactance so the antenna reactance is substantially opposite that of the IC reactance.

Another measure of performance may be bandwidth. Transponders are generally used over a range of frequencies rather than at a single frequency. However, performance with respect to bandwidth typically can be measured in one of three ways: 1) power transfer efficiency at one frequency (commonly the center frequency); 2) worst-case performance over the band, with the band being 902-928 MHz or 900-930 MHz (the antenna resistance in the microstrip mode can be reduced until the optimal worst-case performance over band is reached); or 3) a combination of the first two, where good performance at some frequency (typically the center frequency) is achieved as well as moderate worst-case performance over the entire band.

Figure 4:
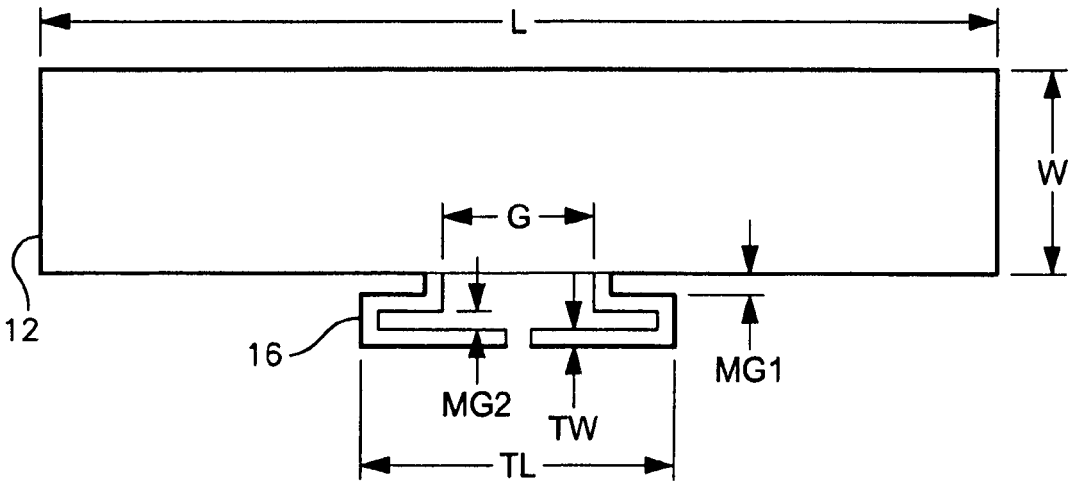
FIG. 4 is a view of a Modified T Match matching circuit in physical communication with, or direct feed to an antenna.

Development of specific embodiments of the RFID device of the present invention may proceed as follows. An RFID device can be generally defined as depicted in FIG. 4. Note that the antenna length is frequently meandered in order to fit within a smaller form factor. Typically, a resonant-length antenna may be 6.1 inches, but is meandered so that the antenna fits within approximately 3.8 inch total length in order to fit within a 4 inch label or roll.

Figure 6:
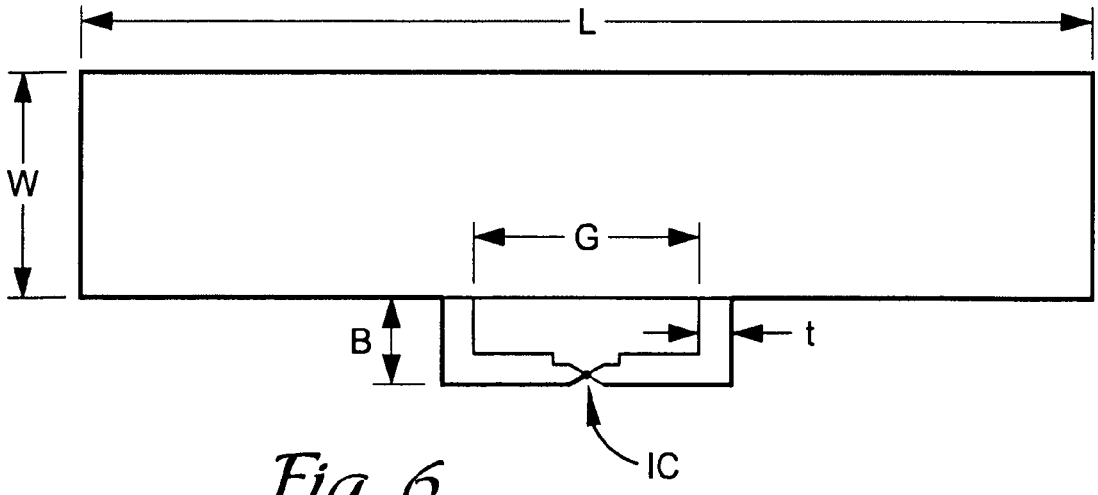
FIG. 6 is a view of a Pure T Match matching circuit in physical communication with, or direct feed to an antenna.
Figure 7:
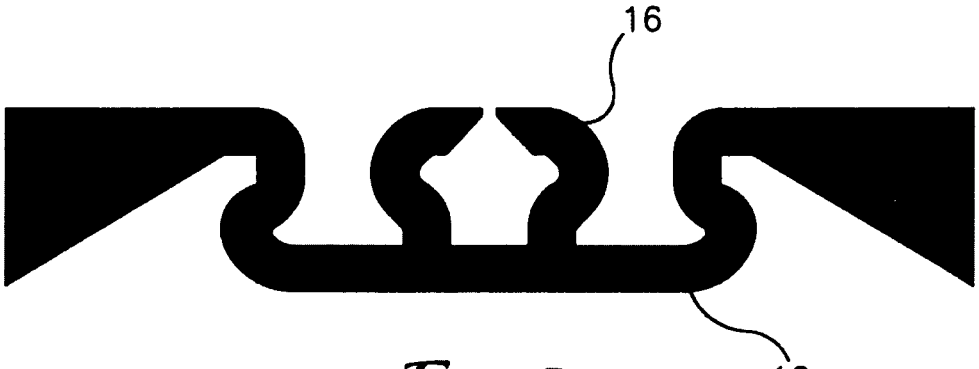
FIG. 7 is a view of a theoretical embodiment of a curved matching circuit in physical communication with, or direct feed to an antenna.
Figure 8:
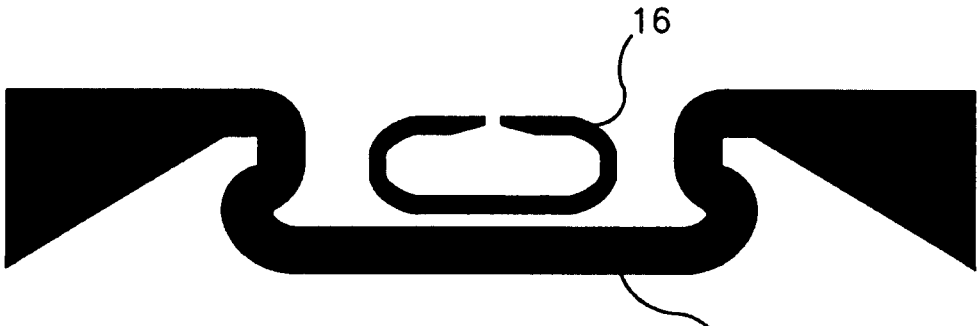
FIG. 8 is a view of a theoretical embodiment of a matching circuit in inductive communication with an antenna.

Note that this may be a simplification in some cases and a generalization of others. A foam-backed RFID device can be further defined in FIG. 5. Thus, the entire device can be defined as a tuple: A=(L, W, G, TW, ML, MG1, MG2, h, $\in_r$, tan δ). FIG. 4 is a view of a modified T Match matching circuit 16 in physical communication with, or direct feed to an antenna 12. In another embodiment, the matching circuit 16 may be described as a Pure T Match, as shown in FIG. 6. In a theoretical embodiment, the matching circuit 16 may be curved, as shown in FIG. 7. In another theoretical embodiment, the matching circuit 16 may be in inductive communication with an antenna 12, as shown in FIG. 8. Thus, it is recognized that the matching circuit 16 can take on a large number of alternate configurations. Note that thinner substrates (h) are generally preferred because thinner substrates reduce material cost and waste, rolls of thinner substrates make comparatively more tags before being changed, thereby decreasing labor costs and increasing machine utilization, and the resulting thinner tags are less likely to be removed through wear.

Without loss of generality, let the metrics of primary interest be D (directivity), η (efficiency), and τ (power transfer efficiency). The realized gain is defined as $G_r$=D η τ. Generally, for a rectangular dipole-like antenna, the directivity in free space is approximately 2.2 dBi, and on an infinite metal ground plane is approximately 8 dBi and largely constrained by the form factor. Let the realized efficiency be defined as E=η τ. Let a superscript "f" denote the free-space parameter and the superscript "m" denote the on-metal parameter, e.g., $\tau^f$ is the power transfer efficiency of the antenna in free space, and $E^m$ is the on-metal realized efficiency.

In one method to identify an acceptable RFID device, a Boolean function, AC(D,η,τ), can be defined which is the acceptance criteria generally stated. Two specific acceptance criteria can also be defined: $AC^f(D^f, \eta^f, \tau^f)$ and $AC^m(D^m, \eta^m, \tau^m)$. Thus, an antenna design is acceptable if both $AC^f$ and $AC^m$ evaluate as "true".

Figure 5:
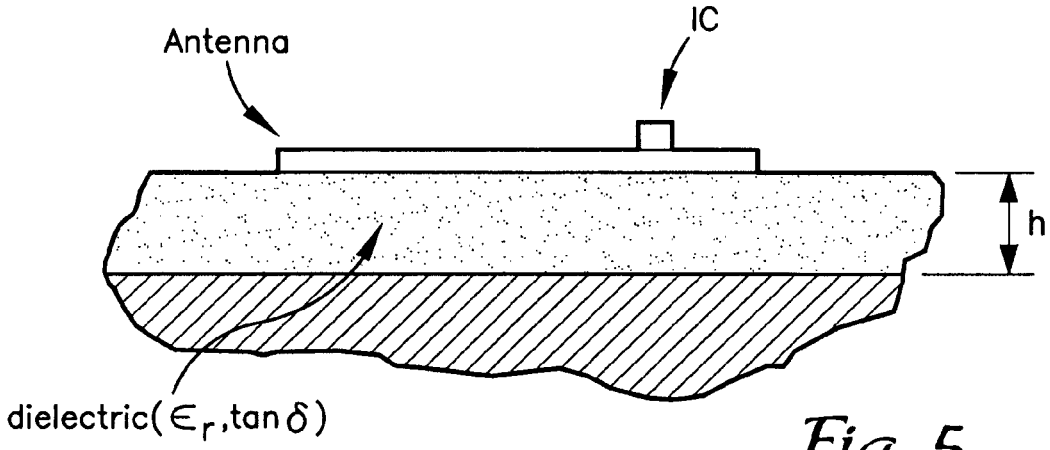
FIG. 5 is a view of a portion of the defining components of an RFID transponder.

Referring to FIGS. 4 and 5, suppose that W, h, $\in_r$, and tan δ are given constraints. Thus, L, G, TW, and TW can be freely ranged. Again, bound the values of $L \in [L_{LB}, L_{UB}]$, $G \in [G_{LB}, G_{UB}]$, $TW \in [TW_{LB}, TW_{UB}]$, and $TL \in [TL_{LB}, TL_{UB}]$. (These choices are arbitrary, but represent a realistic set of constraints.)

Based on the foregoing, an algorithm to find an acceptable antenna is given below.

```
For L ∈ [L_LB,L_UB]
    For G ∈ [G_LB,G_UB]
        For TW ∈ [TW_LB,TW_UB]
            For TL ∈ [TL_LB,TL_UB]
                Compute D^f, η^f, τ^f and D^m, η^m, τ^m.
                If AC^f (D^f,η^f,τ^f)∧ AC^m(D^m,η^m,τ^m) = true
                    STOP WITH ACCEPTABLE SOLUTION
```

This algorithm can be executed exhaustively by stepping through each combination and performing measurements on instantiations or by using a computer simulation tool. A numeral simulation tool, such as method of moment (MOM), can rapidly estimate the free-space performance of an antenna, while a full-wave simulation tool, which tends to be slower, may be required for accurate on-metal simulation. A MOM tool could quickly reduce the solution space to those which satisfy the free-space acceptance criteria, and then only those need be simulated near a conductive surface. An optimization search could be performed over this space as well. If the algorithm terminates without an acceptable solution, one or both acceptance criteria may need to be relaxed.

Experimentally, with reference to FIGS. 4 and 5, two solutions were found for the RFID device of the present invention with L=3.75", W=1.25", h=0.125", $\in_r$=1.085, and tan $\delta$≈0.0015. First, it was found that $D^f$=2.2 dBi, $\eta^f$=−0.1 dB, $\tau^f$=−3.4 dB; $D^m$=7.5 dBi, $\eta^m$=−6.4 dB, $\tau^m$=−0.4 dB. This first solution has excellent power transfer efficiency near a conductive surface, but is relatively inefficient despite a relatively large directivity. In free space, the efficiency is excellent, but the power transfer efficiency is reduced. Second, it was found that $D^f$=2.1 dBi, $\eta^f$=−0.2 dB, $\tau^f$=−0.7 dB; $D^m$=8.5 dBi, $\eta^m$=−6.8 dB, $\tau^m$=−4.4 dB. This antenna performs nearly optimally in free space, but experiences reduced efficiency and power transfer efficiency when near metal. The realized gain near a conductive surface of the second tag is approximately −2 dBi, which is approximately 20 dB larger than a comparable good commercial alternative.

With regard to setting the parameters, the on-metal resonant frequency is set to approximately 960 MHz for 915 MHz operation, which sets L. (It is contemplated that the same thing can be accomplished by setting the on-metal resonant frequency to approximately 870 MHz) Next, LW is set to approximately 5 mm, and G is chosen so that the on-metal antenna resistance is approximately half the chip resistance. Then, LW is chosen so that the on-metal reactance is sufficient. This provides a starting point for the development process.

Next, G, L, TL, and TW are iteratively modified until a suitable solution is found. Small changes in L do not affect the free-space behavior. Generally, increasing G increases both the on-metal and free-space resistance. Increasing TL will increase both the on-metal and free-space reactance, though in different proportions. Increasing TW will decrease the inductance of the matching circuit in free space while decreasing the characteristic impedance of the matching circuit near a conductive surface.

Another method for designing RHID devices that behave near optimally in both free space and when placed near a conductive surface is described as follows. The antenna impedance in free space changes much more slowly with respect to frequency than as a microstrip; thus, an antenna is designed with a length so that the antenna as a microstrip resonates at approximately 960 MHz (although any starting point may be selected). A matching circuit is constructed so that the antenna operates efficiently in free space. So long as the antenna impedance is not excessively inductive, a solution will exist.

The tag is placed near a conductive surface and the impedance is observed, either experimentally or with simulation tools. If the reactance is too small at 915 MHz, then the length of the antenna is increased slightly to reduce the resonant frequency of the antenna as a microstrip. Decreasing the resonant frequency of the antenna as a microstrip will increase the impedance, and specifically the reactance. The length of the antenna can be reduced until the desired reactance is observed.

By adjusting the length of the antenna, the impedance of the antenna in free space has been changed. But, since the antenna impedance in free space changes slowly with respect to frequency, the change in antenna impedance is minimal. The matching circuit must be modified again to provide an optimal impedance in free space.

Once the optimal free-space performance is found, the antenna is again placed near a conductive surface and the reactance is observed. The length of the antenna is adjusted again to achieve the desired reactance as a microstrip. This adjustment is likely to be smaller than in the first instance described above. The process can be iterated until desired free-space performance is achieved and the desired reactance (normally the opposite of the IC reactance) as a microstrip is also achieved.

The process above does not necessarily achieve optimality with regard to the resistance, but it does substantially achieve optimality with respect to reactance. This process may be used to find a solution rapidly. To reduce conductive losses, the traces used to design the antenna should be as wide as possible, especially traces that are near the center of the antenna, as well as those used in the matching circuit. Commercial antennas that use 1 mm wide traces or sometimes even 0.75 mm traces will experience very high conductive losses. For smaller applications, 1 mm-2 mm traces are used. For larger applications, traces of up to approximately 30 mm are used. Preferably, the traces are between 5 mm and 8 mm.

Referring to FIG. 8, if the antenna 12 trace width is uniform, a wider trace has less inductance per unit length than a narrower trace. When increasing the trace width, in order to obtain the same shunt inductance $L_s$ (circuit model), the feeds are attached wider apart. The antenna impedance as a microstrip is proportional to $2R_{rad}\sin^2(2\,g/\lambda)$, where $R_{rad}$ is the radiating resistance observed at the radiating edge, g is the distance between the feeds, and $\lambda$ is the guided wavelength. The impedance is not proportional to the width of the trace. With a wider trace, G is larger to match the impedance in free space, which will increase the impedance as a microstrip. By increasing or decreasing the conductor width W, some control is exerted over the ratio of the antenna resistance operating as a microstrip to the antenna resistance operating as a dipole. As noted above, changing the trace width also affects the conductive loss of the antenna operating as a microstrip. The difference in coupling that occurs in free space and as a microstrip can also be used to control the ratio of the antenna resistance operating as a microstrip to the antenna resistance operating as a dipole.

Referring again to FIG. 8, if the matching circuit 16 traces are placed in close proximity to the antenna 12 traces, the two traces will inductively couple. Depending on the configuration, this can be used essentially as a transformer to increase or decrease the antenna impedance. Furthermore, the traces tend to couple more strongly when operating in free space than as a microstrip. Thus, impedance matching in free space with a large degree of positive coupling can be used to decrease the relative antenna impedance when operating as a microstrip. Similarly, a large degree of negative coupling can be used to increase the antenna impedance when operating as a microstrip.

If the traces used in the matching circuit have varying width, specifically a wide trace followed by a narrow trace (from antenna to IC), then the inductance of the trace in free space will substantially be the sum of the inductance of the two traces. When operating as a microstrip, the change in conductive widths will set up a standing wave, which tends to increase the electrical length and provide a larger reactance than would be obtained by the sum of the two segments thus increasing the inductance of the antenna operating as a microstrip in a way other than changing the resonant frequency of the antenna. Creating large standing waves on the traces tend to increase conductive losses on the antenna.

These describe a few of the ways in which the relative impedance of the transponder can be manipulated both when operating in free space and as a microstrip. By the combination of techniques, optimal or near-optimal impedance matching can be achieved in both free-space and on-metal environments.

Although the invention has been disclosed with reference to one or more particular embodiments, it is understood that equivalents may be employed and substitutions made herein without departing from the contemplated scope of the invention.

The invention may be further characterized as follows:

The invention claimed is:

1. A radio-frequency identification device comprising:

a single antenna having an impedance and behaving as a dipole antenna when the radio-frequency identification device is in free space, and behaving as a balanced-feed microstrip antenna when the radio-frequency identification device is placed near a conductive surface, wherein the antenna has a power transfer efficiency of at least approximately 95% when the radio-frequency identification device is operating in free space and at least approximately 5% when the radio-frequency identification device is placed near the conductive surface; and an integrated circuit connected to the antenna and having a conjugate impedance, wherein the impedance of the antenna approximately matches the conjugate impedance of the integrated circuit when the radio-frequency device is operating in free space, and is within at least approximately 25% of the conjugate impedance of the integrated circuit when the radio-frequency identification device is placed near the conductive surface.

2. The radio-frequency identification device as set forth in claim 1, wherein the power transfer efficiency of the antenna is at least approximately 10% when the radio-frequency identification device is placed near the conductive surface.

3. The radio-frequency identification device as set forth in claim 1, wherein the power transfer efficiency of the antenna is at least approximately 25% when the radio-frequency identification device is placed near the conductive surface.

4. The radio-frequency identification device as set forth in claim 1, wherein the power transfer efficiency of the antenna is at least approximately 80% when the radio-frequency identification device is placed near the conductive surface.

5. The radio-frequency identification device as set forth in claim 1, further including a matching circuit interposed between the antenna and the integrated circuit and at least approximately matching the impedance of the antenna to the conjugate impedance of the integrated circuit.

6. The radio-frequency identification device as set forth in claim 5, wherein the matching circuit is a modified T matching circuit physically connecting the antenna to the integrated circuit.

7. The radio-frequency identification device as set forth in claim 5, wherein the matching circuit is a Pure T matching circuit physically connecting the antenna to the integrated circuit.

8. The radio-frequency identification device as set forth in claim 5, wherein the matching circuit has curved traces physically connecting the antenna to the integrated circuit.

9. The radio-frequency identification device as set forth in claim 5, wherein the matching circuit is physically separated from and inductively coupled with the antenna and connects the antenna to the integrated circuit.

10. The radio-frequency identification device as set forth in claim 1, further including a substrate interposed between the antenna and the conductive surface when the radio-frequency device is placed near the conductive surface.

11. The radio-frequency identification device as set forth in claim 10, wherein the substrate is a foam having a thickness of at least approximately one-eighth inch.

12. The radio-frequency identification device as set forth in claim 10, wherein the substrate comprises an elastomeric material.

13. A radio-frequency identification device comprising:

an single antenna having an impedance and behaving as a dipole antenna when the radio-frequency identification device is in free space, and behaving as a balanced-feed microstrip antenna when the radio-frequency identification device is placed near a conductive surface, wherein the antenna has a power transfer efficiency of at least approximately 95% when the radio-frequency identification device is operating in free space, and at least approximately 5% when the radio-frequency identification device is placed near the conductive surface;

an integrated circuit connected to the antenna and having a conjugate impedance; and a matching circuit interposed between the antenna and the integrated circuit and at least approximately matching the impedance of the antenna to the conjugate impedance of the integrated circuit both when operating in free space and when placed near the conductive surface and wherein the antenna impedance is at least approximately 25% of the conjugate impedance of the integrated circuit when the radio-frequency identification device is placed near the conductive surface.

14. The radio-frequency identification device as set forth in claim 13, wherein the matching circuit is a modified T matching circuit physically connecting the antenna to the integrated circuit.

15. The radio-frequency identification device as set forth in claim 13, wherein the matching circuit is a Pure T matching circuit physically connecting the antenna to the integrated circuit.

16. The radio-frequency identification device as set forth in claim 13, wherein the matching circuit has curved traces physically connecting the antenna to the integrated circuit.

17. The radio-frequency identification device as set forth in claim 13, wherein the matching circuit is physically separated from and inductively coupled with the antenna and connects the antenna to the integrated circuit.

18. A radio-frequency identification device comprising:

a single antenna having an impedance and behaving as a dipole antenna when the radio-frequency identification device is in free space, and behaving as a balanced-feed microstrip antenna when the radio-frequency identification device is placed near a conductive surface, wherein the antenna has a power transfer efficiency of at least approximately 95% when the radio-frequency identification device is operating in free space, and at least approximately 5% when the radio-frequency identification device is placed near the conductive surface, and wherein a signal emitted by the antenna is readable from at least approximately twenty feet when the radio-frequency identification device is operating in free space, and from at least approximately twenty feet when the radio-frequency identification device is placed near the conductive surface;

an integrated circuit connected to the antenna and having a conjugate impedance;

a matching circuit interposed between the antenna and the integrated circuit and at least approximately matching the impedance of the antenna to the conjugate impedance of the integrated circuit both when operating in free space and when placed near the conductive surface, and wherein the impedance of the antenna is within at least approximately 25% of the conjugate impedance of the integrated circuit when the radio-frequency identification device is placed near the conductive surface; and an insulating substrate interposed between the antenna and the conductive surface when the radio-frequency device is placed near the conductive surface.

19. The radio-frequency identification device as set forth in claim 18, wherein the insulating substrate is a foam having a thickness of at least approximately one-eighth inch.

20. The radio-frequency identification device as set forth in claim 18, wherein the insulating substrate comprises an elastomeric material.

* * * * *